US012612565B2

(12) United States Patent
Kang et al.

(10) Patent No.: US 12,612,565 B2
(45) Date of Patent: Apr. 28, 2026

(54) METHOD OF PREPARING LUBE BASE OIL

(71) Applicants: SK INNOVATION CO., LTD., Seoul (KR); SK ENMOVE CO., LTD., Seoul (KR)

(72) Inventors: Minje Kang, Daejeon (KR); Yun Ha Kim, Daejeon (KR); Do Woan Kim, Daejeon (KR); Kyung Seok Noh, Daejeon (KR)

(73) Assignees: SK INNOVATION CO., LTD., Seoul (KR); SK ENMOVE CO., LTD., Seoul (KR)

( * ) Notice: Subject to any disclaimer, the term of this patent is extended or adjusted under 35 U.S.C. 154(b) by 235 days.

(21) Appl. No.: 18/424,874

(22) Filed: Jan. 29, 2024

(65) Prior Publication Data

US 2024/0343983 A1 Oct. 17, 2024

(30) Foreign Application Priority Data

Apr. 11, 2023 (KR) ..... 10-2023-0047782

(51) Int. Cl.
*C10G 65/12* (2006.01)
*C10G 7/00* (2006.01)
*C10M 101/02* (2006.01)

(52) U.S. Cl.
CPC ..... *C10G 65/12* (2013.01); *C10G 7/003* (2013.01); *C10M 101/02* (2013.01); *C10G 2300/302* (2013.01); *C10G 2400/10* (2013.01)

(58) Field of Classification Search
CPC ..... C10G 21/16; C10G 21/20; C10G 2300/1074; C10G 2300/1077;
(Continued)

(56) References Cited

U.S. PATENT DOCUMENTS 10,865,352 B2 12/2020 Gunther et al.
2014/0197075 A1 7/2014 Prentice et al.
(Continued)

FOREIGN PATENT DOCUMENTS

EP 4137553 A1 2/2023
JP H09217079 A 8/1997
(Continued)

OTHER PUBLICATIONS

Extended European Search Report for European Patent Application No. 24153098.9 issued by the European Patent Office on Aug. 16, 2024.
(Continued)

*Primary Examiner* — Ellen M Mcavoy
*Assistant Examiner* — Chantel Graham
(74) *Attorney, Agent, or Firm* — IP & T GROUP LLP

(57) ABSTRACT

The present disclosure provides a method of preparing a lube base oil. The method comprises (a) providing a feed stream, (b) separating the feed stream into at least two fraction streams comprising a first fraction stream and a second fraction stream, and (c) before or after the separating of the feed stream, introducing the feed stream or at least two fraction streams into a first and second hydro-processing treatments to produce at least two product streams, and the first product stream has a higher viscosity index (VI) than the second product stream. The present disclosure also provides a lube base oil and a lubricant composition comprising the lube base oil.

12 Claims, 2 Drawing Sheets

(58) Field of Classification Search
CPC ..... C10G 2300/302; C10G 2400/10; C10G 25/003; C10G 25/03; C10G 25/12; C10G 65/04; C10G 65/12; C10G 7/003; C10M 101/02; C10M 105/04; C10M 2203/1006; C10M 2203/1025; C10N 2020/02
See application file for complete search history.

(56) References Cited

U.S. PATENT DOCUMENTS

| | | | | |
|---|---|---|---|---|
| 2016/0194566 | A1* | 7/2016 | Hoo | C10G 67/00 208/89 |
| 2017/0183578 | A1* | 6/2017 | Hilbert | C10K 3/04 |
| 2018/0127666 | A1 | 5/2018 | Murray | |
| 2019/0390129 | A1 | 12/2019 | McCool et al. | |

FOREIGN PATENT DOCUMENTS

| | | | |
|---|---|---|---|
| JP | 2019-504162 | A | 2/2019 |
| KR | 10-2458858 | B1 | 10/2022 |
| WO | 2017/218602 | A2 | 12/2017 |

OTHER PUBLICATIONS

Office Action for Japanese Patent Application No. 2024-009045 issued by the Japanese Patent Office on Mar. 5, 2025.

* cited by examiner

METHOD OF PREPARING LUBE BASE OIL

CROSS REFERENCE TO RELATED APPLICATION

The present application claims priority to Korean Patent Application No. 10-2023-0047782, filed Apr. 11, 2023, the entire content of which is incorporated herein for all purposes by this reference.

BACKGROUND

1. Technical Field

The present disclosure relates to a method of preparing a lube base oil.

2. Description of the Related Art

Lube base oil is a raw material for lubricants. In general, good lube base oils have a high viscosity index, high stability (highly resistant to oxidation, heat, UV, etc.), and low volatility. The American Petroleum Institute (API) classifies lube base oils as shown in Table 1 below according to their quality.

TABLE 1

| Classification | Sulfur (%) | Saturate (%) | VI (Viscosity Index) |
|---|---|---|---|
| Group I | >0.03 | <90 | 80 ≤ VI < 120 |
| Group II | ≤0.03 | ≥90 | 80 ≤ VI < 120 |
| Group III | ≤0.03 | ≥90 | 120 ≤ VI |
| Group IV | All poly alpha olefins (PAOs) | | |
| Group V | All other lube base oils not included in Group I, II, III, or IV | | |

The quality ascends from Group I to Group IV. Higher-quality lube base oils have a lower sulfur and nitrogen content, a higher viscosity index (VI), a lower pour point, a lower CCS viscosity, and a lower Noack volatility. In addition, the higher the quality of the lube base oil, the higher the paraffin content, the lower the naphthenic content, and the lower the aromatic content.

The viscosity index (VI) is one of the important physical properties for assessing the quality of lube base oils. The VI is an index related to temperature-dependent changes in viscosity. The higher the viscosity index, the smaller the change in viscosity with temperature. Therefore, a lube base oil having a high viscosity index is advantageous in terms of engine protection due to its relatively high viscosity at high temperatures, and it is advantageous in terms of driving an engine pump due to its relatively low viscosity at low temperatures. For this reason, lube base oils with a higher viscosity index are rated as higher-quality base oils.

Due to the tightening of environmental regulations and the needs of viscosity reduction and upgrading engine oil quality, the demand for Group I and II lube base oils with a high impurity content and a low VI is decreasing, and the demand for Group III or higher lube base oils is increasing. In addition, there is a growing market demand for lube base oils (hereinafter, referred to as Group III+ lube base oils) having a viscosity index that is about 5 to 10 or more higher than that of Group III lube base oils.

SUMMARY OF THE DISCLOSURE

The present disclosure provides a method of simultaneously preparing a conventional quality-level lube base oil and a superior quality-level lube base oil from a feed for producing a conventional lube base oil.

The first aspect of the present disclosure relates to a method of preparing a lube base oil, the method comprising: (a) providing a feed stream; (b) separating the feed stream into at least two fraction streams comprising a first fraction stream and a second fraction stream; and (c) before or after the separating of the feed stream, introducing the feed stream or at least two fraction streams into a first and second hydro-processing treatments to produce at least two product streams, the first product stream having a higher viscosity index (VI) than the second product stream.

According to one embodiment, the feed stream comprises vacuum gas oil (VGO), de-asphalted oil (DAO), heavy coker gas oil (HCGO), unconverted oil (UCO), a distillate thereof, pre-prepared lube base oil, or a combination thereof.

According to one embodiment, the (b) is performed through solvent extraction, or adsorption, or both.

According to one embodiment, the first hydro-processing treatment comprises hydro-treatment (HDT), or hydrocracking (HCK), or both.

According to one embodiment, the second hydro-processing treatment comprises hydro-dewaxing (HDW), or hydro-finishing (HDF), or both.

According to one embodiment, the method further comprises (e) fractionating the feed stream or at least two fraction streams.

According to one embodiment, when the kinematic viscosity at 100° C. of the at least two product streams is 2 cSt (centistoke) or more and less than 4 cSt, the first product stream has a VI of 115 or more, and a VI difference between the first product stream and the second product stream is at least 5.

According to one embodiment, when the kinematic viscosity at 100° C. of the at least two product streams is 4 cSt or more and less than 8 cSt, the first product stream has a VI of 130 or more, and a VI difference between the first product stream and the second product stream is at least 5.

The second aspect of the present disclosure relates to a mineral oil-based lube base oil having a kinematic viscosity of 2 cSt or more and less than 4 cSt at 100° C. and a viscosity index (VI) of at least 115.

A third aspect of the present disclosure relates to a mineral oil-based lube base oil having a kinematic viscosity of 4 cSt or more and less than 8 cSt at 100° C. and a viscosity index (VI) of at least 130.

A fourth aspect of the present disclosure relates to a lubricant composition including the mineral oil-based lube base oil of the second or third aspect.

The present disclosure provides a method of simultaneously producing a conventional quality-level lube base oil and a superior quality-level lube base oil from a feed for producing a conventional lube base oil. Accordingly, the range of feeds from which high-quality lube base oils can be produced is expanded, by-products generated in a conventional high quality lube base oil production process are reduced, and the cost of the feed is reduced.

DESCRIPTION OF THE PREFERRED EMBODIMENTS

Figure 1:
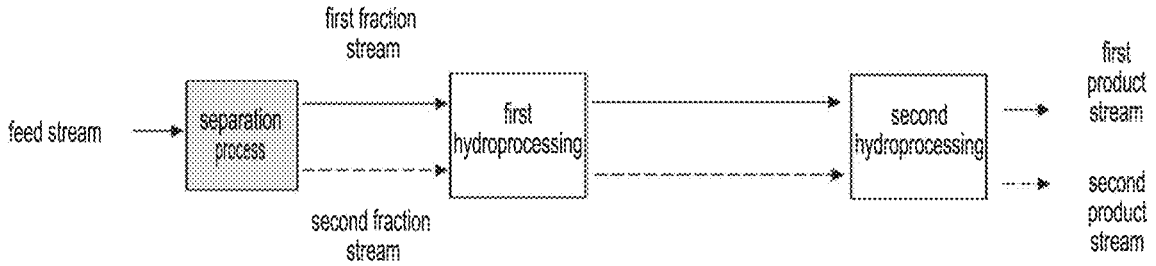
FIGS. 1 to 6 are schematic flowcharts of a method of preparing a lube base oil, according to some embodiments.

The above and other objectives, features, and advantages of the present disclosure will be more clearly understood from the following detailed description taken in conjunction with the accompanying drawings, but the present disclosure is not limited thereto. In describing the present disclosure, when the detailed description of the relevant known technology is determined to unnecessarily obscure the gist of the present disclosure, the detailed description may be omitted.

The present disclosure provides a method of simultaneously producing a conventional quality-level lube base oil and a superior quality-level lube base oil from a feed for producing a conventional lube base oil. In the present disclosure, the simultaneously produced lube base oils include a lube base oil with a conventional level of VI and a lube base oil having a higher level of VI than the conventional level.

In general, there are two known methods for producing lube base oils with higher quality than Group III lube base oils. The methods are i) preparation of synthetic base oils (Group IV) from chemical raw materials, and ii) preparation of high quality base oils through hydro-processing reactions of a feed (starting material) having a high paraffin content. However, in the case of i), there are problems that the raw materials are expensive compared to mineral oil-based lube base oils, and the production amount is restricted because the amount of available raw materials is small. In the case of ii), there is a problem that it is difficult to obtain a feed with a high paraffin content. That is, it is difficult to supply large quantities of lube base oils to the market.

The present disclosure presents a method different from the approaches i) and ii). The method of the present disclosure includes providing a feed stream. The feed is not particularly limited as long as it is a feed from which a lube base oil can be produced. Specifically, the feed may be an existing feed, which is commonly used to produce Group III lube base oils. In one embodiment of the present disclosure, examples of the feed stream may include vacuum gas oil (VGO), de-asphalted oil (DAO), heavy coker gas oil (HCGO), unconverted oil (UCO), distillates of these, pre-prepared lube base oil, and combinations thereof. In the present disclosure, the term "unconverted oil" refers to unreacted oil that has been supplied to a hydrocracking process for producing fuel oil but has not undergone the hydrocracking reaction.

For example, the feed stream may have the following characteristics: 80≤VI; S≤3 wt %; N≤1100 ppm; and final boiling point (FBP)≤620° C.

The method of the present disclosure includes separating the feed stream into at least two fraction streams. In the present disclosure, it should be noted that the separation is not intended to refer to separation carried out based on differences in boiling point. In other words, the separation process does not include a fractional distillation process for oil separation. Additionally, in the present disclosure, the separation is a so-called non-reactive separation process that separates the feed stream without changing the structure of molecules of the feed stream. The separation process in the present disclosure is a process of separating the feed stream into a paraffin-rich fraction stream and a paraffin-poor fraction stream. The at least two fraction streams include the first fraction stream and the second fraction stream. In the present disclosure, the n-th fraction stream is a fraction stream that is paraffin-richer than the n+1-th fraction stream where n is a natural number.

In one embodiment of the present disclosure, the separation process may involve solvent extraction, adsorption, or both. As separation techniques, not only solvent extraction and adsorption, but also membrane separation, thermal diffusion, etc. can be considered. However, in the present disclosure, the separation process is performed through solvent extraction or adsorption in terms of ease of separation and good yield of the first product stream.

The solvent extraction is to obtain a paraffin-rich fraction stream and a paraffin-poor fraction stream by using solubility differences of aromatic components and non-aromatic components contained in the feed stream with respect to a polar solvent.

The solvent is not particularly limited as long as it is a polar solvent that does not react with components in the feed stream and which can separate the feed stream depending on paraffin-richness. In one embodiment of the present disclosure, examples of the solvent include N-methyl-2-pyrrolidone, sulfolane, dimethyl sulfoxide (DMSO), furfural, dimethylacetamide (DMAc), phenol, acetone, aliphatic polyamines, and combinations thereof.

In one embodiment of the present disclosure, the solvent extraction may be performed at a temperature in a range of from about 40° C. to 120° C., a pressure of in a range of from atmospheric pressure to about 10 kg/cm$^2$, and a solvent to feed stream volume ratio in a range of from 1:1 to 12:1. Optionally, an additional process may be performed to remove the solvent from each of the produced fraction streams. More specifically, the temperatures for the solvent extraction may range from about 40° C. to about 120° C. For an embodiment, the temperatures for the solvent extraction may range from about 50° C. to about 100° C. The solvent to feed stream volume ratio may be in a range of from 1:1 to 12:1. For an embodiment, the solvent to feed stream volume ratio may be in a range of from 2:1 to 9:1.

The adsorption is performed by injecting an adsorbent into the feed stream, and the adsorbent may selectively adsorb molecules contained in the feed stream, depending on the polarity of the molecules. The solvent is not particularly limited as long as it is a polar solvent that does not react with components in the feed stream and which can separate the feed stream depending on paraffin-richness. In one embodiment of the present disclosure, examples of the adsorbent include activated carbon, alumina, clay, silica alumina, zirconia, EU-2, ZSM-5, MCM-4, Molecular Sieve 13X, and combinations thereof. The adsorbent may be in granular or powder form with a surface area of about 300 m$^2$/g or more.

In one embodiment of the present disclosure, the adsorption may be performed in a temperature range of from room temperature (25° C.) to about 120° C. Among the streams obtained from the feed stream, the fraction stream that is not adsorbed on the adsorbent is referred to as the first fraction stream, and the fraction stream that is adsorbed on the adsorbent is referred to as the second fraction stream. The second fraction stream may additionally undergo a desorption process in which the second fraction stream is desorbed from the adsorbent. In one embodiment of the present disclosure, the desorption is performed at a temperature of at least about 200° C. The temperature may be specifically in a range of from about 200° C. to about 500° C., and more specifically a range of from about 200° C. to 400° C.

In the present disclosure, the separation process may be performed once to produce only the first fraction stream and the second fraction stream, but can be performed two or more times if necessary.

The method of the present disclosure includes introducing the above-described feed stream or at least two fraction streams into the first hydro-processing. The first hydro-processing may be performed before or after the separation process. When the first hydro-processing is carried out before the separation process, the feed stream having passed through the first hydro-processing is introduced into the separation process. When the first hydro-processing is carried out after the separation process, each of the at least two fraction streams produced in the separation process is independently introduced into the first hydro-processing.

In one embodiment of the present disclosure, the first hydro-processing involves hydrotreating (HDT), hydrocracking (HCK), or both. The hydrotreating and hydrocracking can be performed under known process conditions therefore, respectively. For example, each of the hydrotreating and hydrocracking can be performed under the process conditions applied to a conventional Group III lube base oil production process. Additionally, when both the hydrotreating and the hydrocracking are involved in the first hydro-processing, the separation process of the present disclosure may be performed between the hydrotreating and the hydrocracking.

In one embodiment of the present disclosure, when the first hydro-processing is performed before the separation process, the unconverted oil may be fed as an additional stream after the first hydro-processing is performed, and then mixed with the feed stream having passed through the first hydro-processing. This mixed stream can be treated as the feed stream described later and can be introduced into the subsequent process.

The method of the present disclosure includes introducing the above-described feed stream or at least two fraction streams into the second hydro-processing. The second hydro-processing is performed after the first hydro-processing. The second hydro-processing may be performed before or after the separation process described above. When the second hydro-processing is carried out before the separation process, the feed stream having passed through the second hydro-processing is introduced into the separation process. When the second hydro-processing is carried out after the separation process, each of the at least two fraction streams produced in the separation process is independently introduced into the second hydro-processing. In terms of quality and yield of the end products, specifically, the separation process may be performed at an upstream stage of the second hydro-processing. Here, the upstream stage of the second hydro-processing may refer to both: an upstream stage of the first hydro-processing; and a stage between the end of the first hydro-processing and the beginning of the second hydro-processing.

In one embodiment of the present disclosure, the second hydro-processing involves hydro-dewaxing (HDW), hydro-finishing (HDF), or both. The hydro-dewaxing and hydro-finishing may be performed under known process conditions therefore, respectively. For example, each of the hydro-dewaxing and hydro-finishing may be performed under the process conditions applied to a conventional Group II lube base oil production process. Additionally, when both the hydro-dewaxing and the hydro-finishing are involved in the second hydro-processing, the separation process of the present disclosure may be performed between the hydro-dewaxing and the hydro-finishing.

In one embodiment of the present disclosure, when the second hydro-processing is performed before the separation process, a pre-prepared lube base oil may be supplied as an additional stream after the second hydro-processing is performed, and then mixed with the feed stream having passed through the second hydro-processing. This mixed stream can be treated as the feed stream having passed through the second hydro-processing described above and can be introduced into the subsequent separation process. Examples of the pre-prepared lube base oil in the present disclosure may include not only lube base oils produced from a production line separated from the production line on which the production by the method of the present disclosure is performed but also some of the remaining product streams other than the first product stream produced by the method of the present disclosure. For example, the pre-prepared lube base oil may be a premade lube base oil having the same base oil grade as the second product stream of the present disclosure.

In one embodiment of the present disclosure, the method may further include subjecting the feed stream or at least two fraction streams to fractional distillation (or vacuum distillation) after the first hydro-processing. The fractional distillation process may be performed before or after the second hydro-processing or the separation process. Through the fractional distillation process, a distillation feed stream or a distillation fraction stream can be obtained from the feed stream or fraction stream. Optionally, a plurality of distillation feed streams or a plurality of distillation fractionation streams may be obtained from each of the feed stream or fractionation streams through the fractional distillation process according to boiling points (or kinematic viscosity levels).

Here, the distillation feed stream(s) and distillation fraction stream(s) each refer to unreacted fraction stream(s) in which the reaction did not proceed in the first hydro-processing. The remaining fraction stream(s) other than the distillation feed stream(s) and distillation fraction stream(s) obtained through the fractional distillation process may be utilized in the subsequent processes, such as a fuel oil preparing process that is separate from the process of the present disclosure. For example, the boiling point(s) of the remaining fraction stream(s) may be below the boiling point of light oil (about 310° C.).

Flowcharts of various embodiments for a lube base oil production method according to the present disclosure are shown in FIGS. 1 to 6. It should be noted that the embodiments described in the attached drawings are for illustration and reference, and are not intended to limit the scope of the present disclosure by the drawings.

Figure 2:
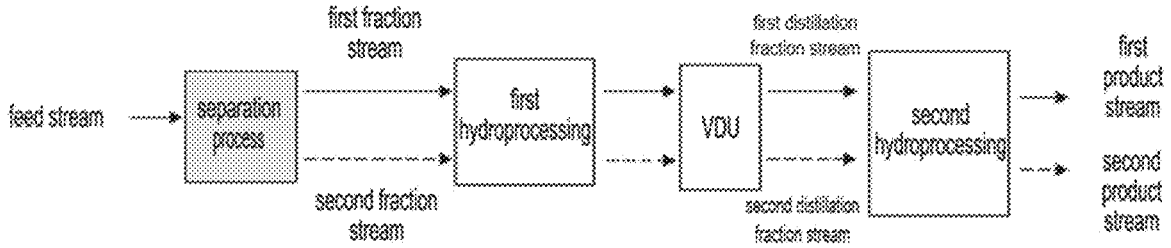

Referring to FIGS. 1 and 2, a feed stream is first separated into at least two fraction streams including the first fraction stream and the second fraction stream through a separation process, and each of the fraction streams is subjected to the first hydro-processing and the second hydro-processing in sequence to produce at least two product streams. The fractional distillation process VDU may be performed at a downstream stage of the first hydro-processing, or at an upstream stage or downstream stage of the second hydro-processing. As illustrated in FIG. 2, when the fractional distillation process VDU is performed at an upstream stage of the second hydro-processing, each of the at least two distillation fraction streams including the first distillation fraction stream and the second distillation fraction stream is introduced into the second hydro-processing, as a process feed to produce at least two product streams.

Figure 3:
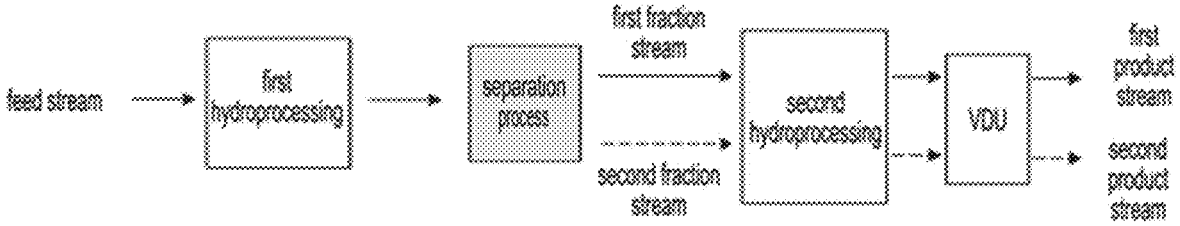
Figure 4:
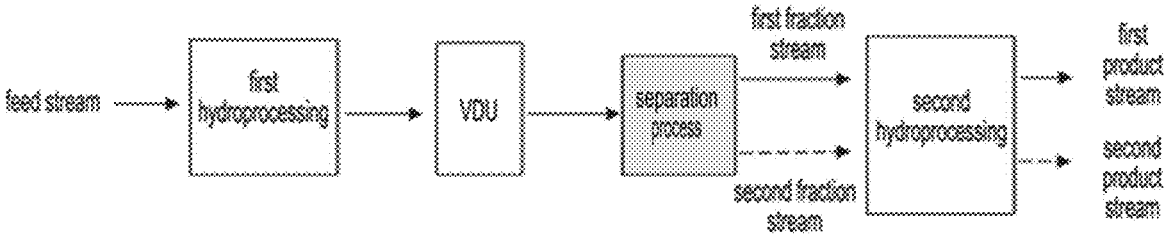

Referring to FIGS. 3 and 4, the feed stream first undergoes the first hydro-processing and then undergoes the separation process, thereby separating into at least two fraction streams. The at least two fraction streams then undergo the second hydro-processing to produce at least two product streams. As illustrated in FIGS. 3 and 4, the fractional distillation process VDU may be performed at a downstream stage of the second hydro-processing or an upstream stage of the separation process. In the case where the fractional distillation process VDU is performed at an upstream stage of the separation process or the second hydro-processing, it will be easily understood by those skilled in the art even though not specifically mentioned here that the feed to be introduced into the separation process or the second hydro-processing is changed to a distillation feed stream or a distillation fraction stream.

Figure 5:
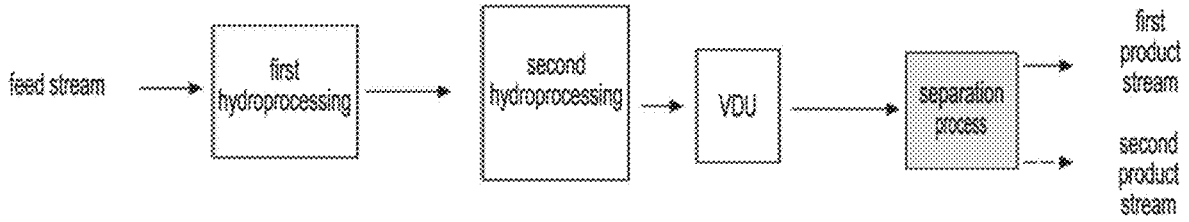
Figure 6:
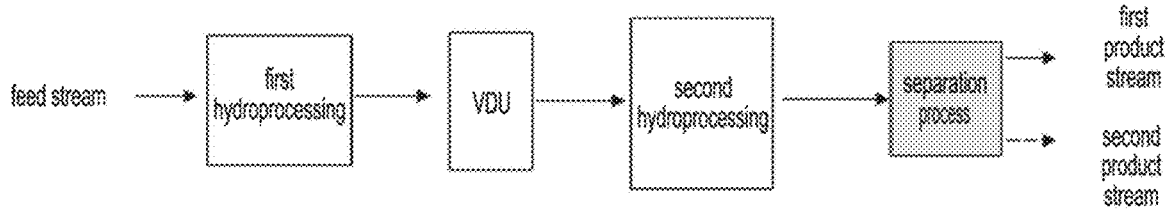

Referring to FIGS. 5 and 6, the feed stream first undergoes the first and second hydro-processings and then undergoes the separation process, thereby separating into the first product stream and the second product stream. The fractional distillation process VDU may also be performed in this case. The fractional distillation process VDU may be performed at either an upstream stage or a downstream stage of the second hydro-processing.

As confirmed from FIGS. 1 through 6, the separation process of the present disclosure may be performed at an upstream stage of the second hydro-processing or a downstream stage of the second hydro-processing. In terms of the quality control of lube base oils as the end products, the separation step may be performed at an upstream stage of the second hydro-processing. Here, the upstream stage of the second hydro-processing may refer to both: an upstream stage of the first hydro-processing; and a stage between the end of the first hydro-processing and the beginning of the second hydro-processing.

The method of the present disclosure produces at least two product streams including the first product stream and the second product stream. The first product stream is characterized as having a higher VI than the second product stream. In the present disclosure, the n-th product stream has a higher VI than the n+1-th product stream where n is a natural number.

As illustrated in FIGS. 5 and 6, when the separation process is performed at a downstream stage of the second hydro-processing, each of the at least two fraction streams may produce at least two product streams. In addition, as illustrated in FIG. 3, when the fractional distillation process is performed at a downstream stage of the second hydro-processing, each of the at least two distillation fraction streams may produce at least two product streams.

In one embodiment of the present disclosure, when the kinematic viscosity at 100° C. of the at least two product streams is about 2 cSt or more and less than 4 cSt, the first product stream has a VI of about 115 or more, i.e., in a range of from 115 to 150, 115 to 140, 115 to 130, 115 to 125, or 115 to 120. In this case, a VI difference between the first product stream and the second product stream is at least 5, i.e., in a range of from about 5 to 30, 5 to 20, 5 to 10, 10 to 30, or 10 to 20. In another embodiment of the present disclosure, when the kinematic viscosity at 100° C. of the at least two product streams is 4 cSt or more and less than 8 cSt, the first product stream has a VI of about 130 or more, i.e., in range of from 130 to 150, 130 to 145, or 130 to 140, and a VI difference between the first product stream and the second product stream is at least 5, i.e., in a range of from about 5 to 30, 5 to 20, 5 to 10, 10 to 30, or 10 to 20.

The second product stream obtained by the method of the present disclosure may have the same base oil grade as a product obtained through a conventional base oil production method in which no separation process is performed.

In one embodiment of the present disclosure, the content of the first product stream with respect to the total product stream is at least about 10 wt %, i.e., in a range of from 10 to 90 wt %, about 10 to 70 wt %, about 10 to 50 wt %, or about 10 to 30 wt %. Specifically, the content of the first product stream with respect to the total product stream is at least about 15 wt %, i.e., in a range of 15 to 90 wt %, about 15 to 70 wt %, about 15 to 50 wt %, or about 15 to 30 wt %. More specifically, the content of the first product stream with respect to the total product stream is at least about 20 wt %, i.e., in a range of about 20 to 90 wt %, about 20 to 70 wt %, about 20 to 50 wt %, or about 20 to 30 wt %. Even more specifically, the content of the first product stream with respect to the total product stream is at least about 25 wt %, i.e., in a range of about 25 to 90 wt %, about 25 to 70 wt %, about 25 to 50 wt %, or about 25 to 30 wt %.

The present disclosure provides a mineral oil-based lube base oil that can be produced by the processes described above. For example, the mineral oil-based lube base oil may have a kinematic viscosity of 2 cSt or more and less than 4 cSt at 100° C. and a VI of at least 115. Alternatively, the mineral oil-based lube base oil may have a kinematic viscosity of 4 cSt or more and less than 8 cSt at 100° C. and a VI of at least 130.

Additionally, the present disclosure also provides a lubricant composition containing the above-described mineral oil-based lube base oil. In one embodiment of the present disclosure, the lubricant composition contains the above-described mineral oil-based lube base oil in an amount of at least about 50 wt %, i.e., in a range of from about 50 to 100 wt %, about 60 to 100 wt %, about 70 to 100 wt %, about 80 to 100 wt %, about 90 to 100 wt %, or 90 to 97 wt %.

The mineral oil-based lube base oil and the lubricant composition containing the same lube base oil have a higher VI than conventional base oils and convention lubricant compositions, and can be expected to be used as high quality products.

Hereinafter, embodiments of the present invention are presented to help the understanding of the present disclosure, but the following examples are provided only for easier understanding of the present disclosure, and thus the present disclosure is not limited thereto.

Example

The properties of a product (comparative example) obtained by performing the same lube base oil preparing process of the present disclosure except for the separation process (the separation process is not performed) and the properties of first and second products obtained by performing the same lube base oil preparing process of the present disclosure were compared. Solvent extraction and adsorption were used as techniques for the separation process.

In the case of the solvent extraction, NMP was used as a solvent, and the extraction was performed at a solvent to oil volume ratio of approximately 2:1 to 9:1, an extraction temperature of 30° C. to 90° C., and atmospheric pressure.

In the case of the adsorption, activated carbon was used as an adsorbent, and the adsorption was carried out under conditions of an adsorption temperature of 60° C. to 120° C. and a desorption temperature of 200° C. to 400° C. The property comparison results are shown in Tables 2 and 3 below.

TABLE 2

| | Measurement method | Comparative Example | First product | Second product |
|---|---|---|---|---|
| Grade of lube base oil | | Gr III | Gr III+ | Gr III |
| Content (wt %) with respect to all products | — | 100 | 26 | 74 |

TABLE 2-continued

| | Measurement method | Comparative Example | First product | Second product |
|---|---|---|---|---|
| Kinematic viscosity @100° C., cSt | ASTM D445 | 4.14 | 4.105 | 4.154 |
| Viscosity index (VI) | ASTM D2270 | 124 | 132 | 120 |

TABLE 3

| | Measurement method | Comparative Example | First product | Second product |
|---|---|---|---|---|
| Grade of lube base oil | | Gr III | Gr III+ | Gr III |
| Content (wt %) with respect to all products | — | 100 | 20 | 80 |
| Kinematic viscosity @100° C., cSt | ASTM D445 | 4.22 | 4.08 | 4.26 |
| Viscosity index (VI) | ASTM D2270 | 122 | 131 | 120 |

Referring to Tables 2 and 3, it can be seen that the method of the present disclosure can simultaneously produce the first base oil having the grade of a conventional base oil and the second base oil having a higher grade than the conventional base oil.

While the present invention has been described with respect to the specific embodiments, it will be apparent to those skilled in the art that various changes and modifications may be made without departing from the scope of the invention.

What is claimed is:

1. A method of preparing at least two lube base oil products, the method comprising:

(a) providing a feed stream;

(b) separating the feed stream into at least two fraction streams, comprising a first fraction stream a second fraction stream, wherein the separating of the feed stream comprises solvent extraction, or adsorption, or both; and (c) introducing the at least two fraction streams into a first hydro-processing treatment, followed by a second hydro-processing treatment to produce at least two product streams, wherein the first product stream has a higher viscosity index (VI) than the second product stream.

2. The method of claim 1, wherein the feed stream comprises vacuum gas oil (VGO), de-asphalted oil (DAO), heavy coker gas oil (HCGO), unconverted oil (UCO), a distillate thereof, a premade lube base oil having the same base oil grade as the second product stream, or a combination thereof.

3. The method of claim 1, wherein the separating of the feed stream comprises solvent extraction, or adsorption, or both.

4. The method of claim 1, wherein the first hydro-processing treatment comprises hydro-treatment (HDT), or hydrocracking (HCK), or both.

5. The method of claim 1, wherein the second hydro-processing treatment comprises hydro-dewaxing (HDW), hydro-finishing (HDF), or both.

6. The method of claim 1, further comprising conducting fractional distillation after the first hydro-processing treatment.

7. The method of claim 1, wherein when a kinematic viscosity at 100° C. of the at least two product streams is 2 cSt or more and less than 4 cSt, the first product stream has a viscosity index (VI) of 115 or more, and a VI difference between the first product stream and the second product stream is at least 5.

8. The method of claim 1, wherein when a kinematic viscosity at 100° C. of the at least two product streams is 4 cSt or more and less than 8 cSt, the first product stream has a VI of 130 or more, and a VI difference between the first product stream and the second product stream is at least 5.

9. A method of preparing at least two lube base oil products, the method comprising:

(a) providing a feed stream;

(b) introducing the feed streams into a first hydro-processing treatment to produce a treated stream, wherein the separating of the feed stream comprises solvent extraction, or adsorption, or both, (c) separating the treated stream to produce at least two fraction streams; and (d) introducing the at least two fraction streams into a second hydro-processing treatment to produce at least two product streams, wherein the first hydro-processing treatment comprises hydro-treatment (HDT), or hydrocracking (HCK), or both, wherein the second hydro-processing treatment comprises hydro-dewaxing (HDW), hydro-finishing (HDF), or both, and wherein the first product stream has a higher viscosity index (VI) than the second product stream.

10. The method of claim 9, further comprising conducting fractional distillation after the first hydro-processing treatment.

11. A method of preparing at least two lube base oil products, the method comprising:

(a) providing a feed stream;

(b) introducing the feed streams into a first hydro-processing treatment to produce a first treated stream, wherein the separating of the feed stream comprises solvent extraction, or adsorption, or both (c) introducing the at first treated streams into a second hydro-processing treatment to produce a second treated stream, and (d) separating the second treated stream to produce at least two product streams, wherein the first hydro-processing treatment comprises hydro-treatment (HDT), or hydrocracking (HCK), or both, wherein the second hydro-processing treatment comprises hydro-dewaxing (HDW), hydro-finishing (HDF), or both, and wherein the first product stream has a higher viscosity index (VI) than the second product stream.

12. The method of claim 11, further comprising conducting fractional distillation after the first hydro-processing treatment.

* * * * *